United States Patent [19]

Maglica et al.

[11] Patent Number: 4,885,668

[45] Date of Patent: Dec. 5, 1989

[54] HEAT SHIELD

[75] Inventors: Anthony Maglica, Ontario; Ralph E. Johnson, Los Alamitos, both of Calif.

[73] Assignee: Mag Instrument, Inc., Ontario, Calif.

[21] Appl. No.: 208,266

[22] Filed: Jun. 17, 1988

[51] Int. Cl.[4] ..... F21V 7/20

[52] U.S. Cl. ..... 362/345; 362/208; 362/294

[58] Field of Search ..... 362/294, 345, 373, 157, 362/202, 208

[56] References Cited

U.S. PATENT DOCUMENTS 4,563,730 1/1986 Saito ..... 362/294 X 4,703,401 10/1987 Ichihara et al. ..... 362/345 X

*Primary Examiner*—Stephen F. Husar

*Attorney, Agent, or Firm*—Lyon & Lyon

[57] ABSTRACT

A flashlight reflector assembly including the substantially parabolic reflector having on one surface a reflectorized material, having a hole through its center as its converging end, and a plurality of support ribs extending from the backside of the reflector wherein a stainless steel heat shield is press fit into the back side of the reflector for protecting the reflector from over temperature conditions by reflecting heat back into the lamp and by conducting heat away from the converting portion of the reflector outward to the plurality of pins located behind the reflector reflecting surface.

16 Claims, 2 Drawing Sheets

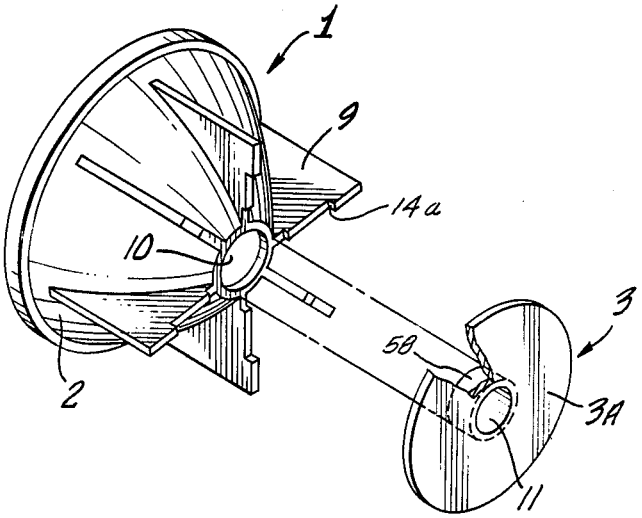
FIG. 1.
FIG. 2.
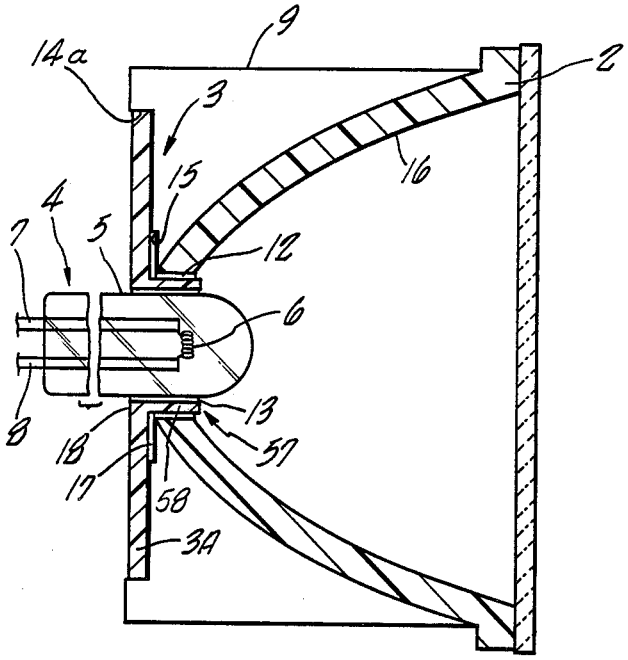
FIG. 6.
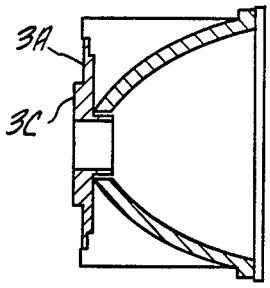
FIG. 7.
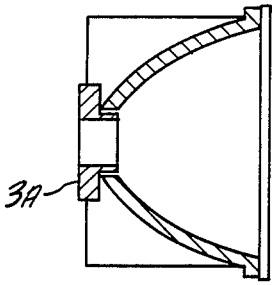
FIG. 8.
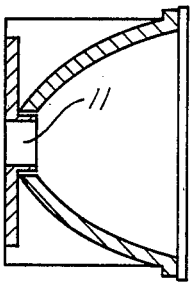
FIG. 9.
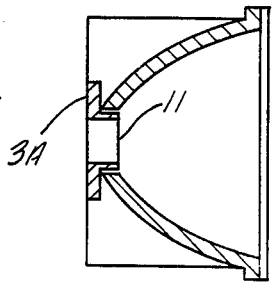
FIG. 10.
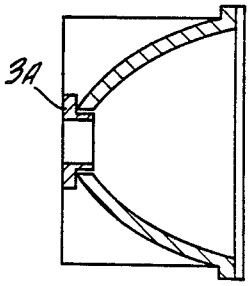

HEAT SHIELD

BACKGROUND OF THE INVENTION

This invention relates to a reflector assembly which protects against over temperature conditions and subsequent distortion of a substantially parabolic reflector in the region near its converging end due to use of high temperature lamps.

Conventional flashlights typically use a vacuum type lamp. These vacuum lamps do not produce temperatures sufficiently high to distort and degrade conventional plastic based reflectors. Also, although high temperature, usually gas-filled, lamps are known in the flashlight and portable lighting industry, it is common to use metal based reflectors with such lamps to thereby avoid the distortion problems which would otherwise be created with use of plastic based reflectors.

OBJECTS OF THE INVENTION

It is an object of the present invention to provide a heat shield for a plastic base reflector.

It is a further object of the present invention to provide a heat shield and heat conducting member for use in conjunction with a flashlight reflector.

It is a further object of the present invention to provide a plastic-bodied reflector which is capable of withstanding the high temperature environments produced by gas-filled, high temperature lamps.

It is a further object of the present invention to provide a metal heat shield which reflects heat and light back into the lamp of a flashlight and also conducts heat away from a region near a flashlight lamp to prevent distortion of a reflector surface near the lamp.

SUMMARY OF THE INVENTION

The present invention is directed to a reflector assembly for use with lighting products, such as flashlights. The reflector assembly includes a reflector with a reflectorized surface and a heat shield positioned so as to prevent extreme temperatures from a high temperature lamp causing distortions on the reflectorized surface of the reflector and thereby causing degradation of the reflected light beam. The reflector is generally a parabolic type reflector having, preferably, a plastic type body with an aluminum reflectorized surface, although the reflector may be made of other materials. The heat shield of the present invention used in conjunction with the reflector is some other material which will reflect light and heat back into the lamp which and will also conduct heat from the lamp to remote regions of the reflector or to a non-reflector heat sink so as to prevent a path of heat from the lamp to areas of the reflector which could be damaged sufficient to cause distortions in the reflectorized surface.

The heat shield includes an annular disc of a predetermined thickness having a tubular portion extending perpendicular from the annular disc at its central hole and extending to a predetermined distance sufficient to provide substantial reflection of light and heat into the lamp as well as conduction of heat away from the lamp to prevent high temperature conditions in the body of the reflector near its reflecting surface. The heat shield is positioned at the converging end of the reflector and is also sized and positioned within the reflector so as to create air gaps between the bulb and the heat shield, between the heat shield and the reflector body in a direction radially outward from the filament of the lamp bulb and between the heat shield and the reflector body extending radially outward from the lower edge of the tubular portion where it merges with the annular disc portion of the heat shield and above the disc portion. The back side of the reflector is provided with recess areas sufficient to provide the air gaps between the heat shield and the reflector and inserts or recesses to provide for a tight fit at distal regions of the disc portion of the heat shield. Such regions of the reflector may be formed integral with the body and form a plurality of ribs which extend backward and away from the reflectorized surface of the reflector to not only anchor the heat shield, but also to act as heat sinks.

BRIEF DESCRIPTION OF THE DRAWINGS

FIG. 1 is an exploded, rear perspective view of a preferred reflector assembly of the present invention.

FIG. 2 is a cross-sectional view of the FIG. 1 reflector assembly, shown with a lamp in a position as may be found during operation of a flashlight having a reflector assembly as shown in FIG. 1.

FIG. 6 is a cross-sectional view of a first alternate embodiment of a reflector assembly of the present invention.

FIG. 7 is a cross-sectional view of a second alternate embodiment of a reflector assembly of the present invention.

FIG. 8 is a cross-sectional view of a third alternate embodiment of a reflector assembly of the present invention.

FIG. 9 is a cross-sectional view of a fourth alternate embodiment of the reflector assembly of the present invention.

FIG. 10 is a cross-sectional view of a fifth alternate embodiment of a reflector assembly of the present invention.

DETAILED DESCRIPTION OF PREFERRED EMBODIMENTS

Figure 3:
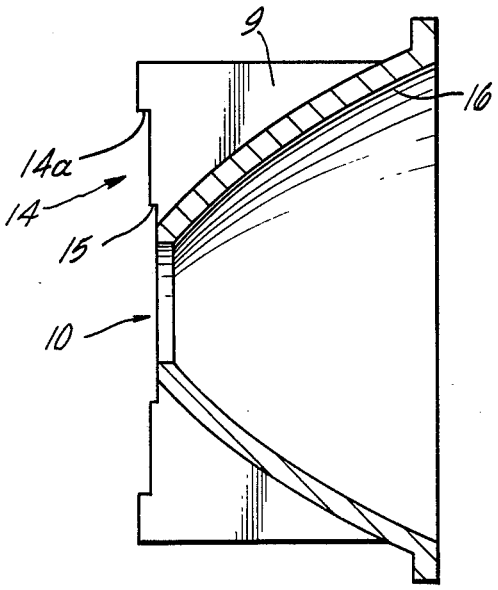
FIG. 3 is a cross-sectional view of the FIG. 1 reflector assembly without its accompanying heat shield.
Figure 4:
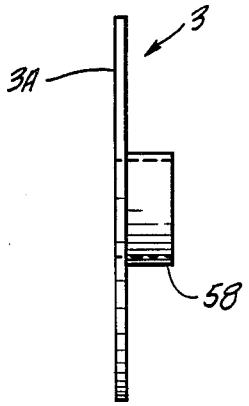
FIG. 4 is a cross-sectional view of a heat shield of the FIG. 1 reflector assembly, without the reflector.
Figure 5:
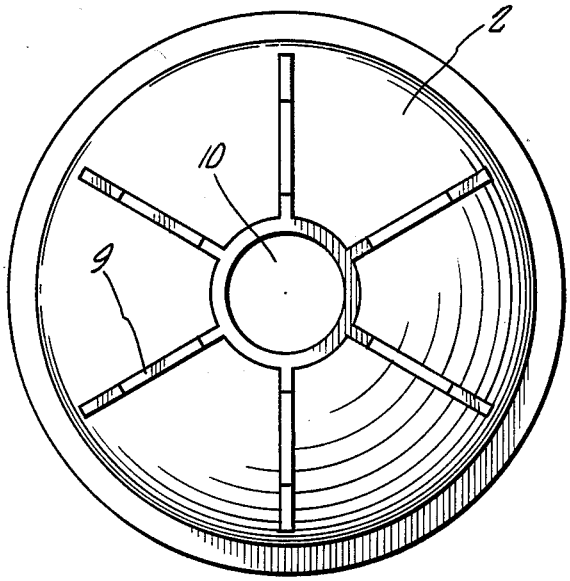
FIG. 5 is a rear view of the FIG. 1 reflector without the accompanying heat shield.

By reference to FIGS. 1–10 preferred embodiments of the reflector assembly of the present invention will be described.

Referring to FIG. 1 an exploded, rear perspective view of a preferred reflector assembly of the present invention is shown generally at 1. The reflector assembly includes a reflector body 2 having ribs 9, and heat shield 3 with an aperture 10 in its center for insertion of a lamp.

The reflector assembly 1 of the present invention may be used in conjunction with virtually any lighting product, but is preferably for use with flashlights of the type disclosed in co-pending application Ser. No. 111,538, filed Oct. 23, 1987, pending, or in U.S. Pat. Nos. 4,577,263, 4,656,565, and 4,658,336. Also, the reflector assembly of the present invention is most preferably used in those flashlights having relatively high-intensity lamps which produce correspondingly high temperatures at the filament and adjacent to the lamp near the flashlight reflector. When such high temperature lamps, usually those filled with a gas such as xenon are used, sufficiently high temperatures adjacent the lamp are produced to cause distortions in the reflector surface and degradation of reflected light from reflectorized surfaces of conventional plastic body reflectors. Although it is known to use steel-body reflectors, such reflectors are relatively expensive and difficult to manufacture. Accordingly it is an object of the present invention to provide a plastic-bodied reflector which is capable of withstanding the high temperature environments produced by gas-filled high temperature lamps.

Referring to FIG. 2, which is a cross-sectional view of the FIG. 1 reflector assembly, including a typical flashlight lamp 4 placed in position as may be found during normal operation of a flashlight and which will produce the most severe temperatures at the converging region of the reflector body. The lamp 4 is shown having glass envelope or bulb 5, filament 6, and pins 7 and 8 for providing a source of light. The lamp 4 is shown as a bare base, bi-pin type lamp. The present invention may be used in conjunction with other types of lamps. Typically, the bulb 5 is filled with a gas such as xenon which may or may not be under pressure. As is well known, such gas-filled lamps produce a relatively bright light, with correspondingly relatively high temperatures at the filament and adjacent to the bulb 5, as shown at 57. A reflector 2 is shown with a reflectorized surface 16 on its concave surface for reflecting light emitted from filament 6 and for focusing the beam of light out through a lens, shown by unnumbered phantom lines. Reflectorized material 16 may be placed on the reflector body 2 by conventional means. Reflector body 2 is shown with a plurality of ribs 9, which are also shown in FIGS. 1-3 and 5.

The shield 3 of the present invention includes a disc portion 3A having a centrally disposed aperture 11 therein and defining a tubular portion 58 extending perpendicularly therefrom. The shield 3 may be press fit into the main body of the reflector 2 with the tubular portion 58 of the shield 3 extending through the central aperture 10 in the reflector 2 and the disc portion 3A being disposed within a circular, recessed area 14 formed in the rearward end surfaces of ribs 9.

As shown in FIG. 2, a small axially extending air gap 13 is formed between the outer periphery of bulb 5 and the inner periphery of tubular portion 58 of shield 3. A second small axially extending air gap 12 is established between the outer periphery of the tube portion 58 of shield 3 and the inner periphery of the central aperture 10. A third air gap 15 radially extends between the forward surface of the disc portion 3A and the backside of reflector 2 adjacent aperture 10. Air gap 15 communicates with the axially projecting air gap 12.

The reflector body 2 is preferably made of a high temperature plastic material such as, for example, Ultem TM. Other known, high temperature plastics may be used as the reflector body material. The reflector body material maintains a smooth surface for the reflector material 16 during extended operation with high temperature lamps. The reflector material 2 also functions to provide a smooth surface, that is, a surface having relatively few or no flow lines or seams to, provide for excellent optical properties when coated with reflectorized material 16. The reflector body material must also be relatively strong and must exhibit minimal shrinkage, that is no more than about 1% mold shrinkage when solidifying from liquid to solid state. In order to minimize potential optical distortions when coated with reflectorized material 16, it is preferred that the material used for the reflector body have a heat deflection temperature of at least about 445° F., although materials having deflection temperatures as low as 385° F. are acceptable for the purposes of the present invention. The plastic body 2 of the reflector may be made with conventional injection molding techniques.

In the absence of a means to remove excess heat, such as the reflector-heat shield assembly of the present invention, high temperature lamps, such as gas-filled lamps in may cause distortion on the reflectorized surface 16 of the reflector body. Typically, the reflectorized surface is a thin coating of aluminum which may become distorted where excess heat has caused distortions and/or bubble formation within the body of the reflector 2. Such distortions result in degradation of the reflected beam of light through the lens.

The shield 3 is preferably made of a material which provides good reflection of light back into the bulb and also provides good conduction of heat from the tubular portion 58 of the shield 3 to the disc portion 3A and then to the ribs 9 of the reflector body 2. Stainless steel, type 303, 304, or 316 is preferred. Other materials which function to provide acceptable reflection and conduction properties may be used in the present invention.

The stainless steel heat shield 3 may be made by conventional machining or stamping processes. The heat shield 3 may also be made with burrs at the ends of the disc portion 3A, to prevent falling out, or rotation the shield 3 relative to the reflector 2.

As shown in FIG. 2, the filament 6 is positioned adjacent to and radially inward of tubular portion 58 of the heat shield 3. In this position of maximum potential heat transfer to the reflector, and assuming no heat shield were in place, the temperatures reached from use of a gas-filled lamp such as a xenon lamp, could, in many instances, create temperatures high enough to cause melting of plastic reflector material and consequent distortion of the optical surface 16 on the reflector body 2 with consequent degradation in the optical characteristics of the beam emitted from the flashlight.

It has been found that with a typical gas-filled lamp 4 that a temperature at bulb 5 of filament 6 of approximately 435° F. may be achieved, depending upon the voltage, gas-fill and current used in the particular lamp application. Generally, it is desirable in flashlight applications to use as much power from the battery as available to give maximum brightness, or light, consistent with a predetermined useful battery expected lifetime. In the case of a three cell, AA sized flashlight wherein the three cells are oriented in series to provide approximately 4.5 volts of electric potential, it has been found that a lamp drawing approximately 400 milliamperes of current will result in a battery life of about 3 hours or more. With such design criteria, it has been determined that the equilibrium temperature of the bulb glass at 57 is at about 460° F. With an equilibrium temperature maximum of about 460° F. at the bulb at the closest point to the filament, it is desired to achieve a corresponding equilibrium temperature in the relector body which is low enough to prevent distortion and/or degradation of the reflector material, and in turn to prevent degradation of reflector performance.

It has been determined that when the bulb glass temperature is about 460° F. as shown at 57, the corresponding temperature of the tubular portion 58 of the heat shield is about 375° F. As heat is conducted from the tubular portion 58 through the disc portion 3A of the heat shield 3, the temperature at the outer radial periphery of the disc portion 3A of the shield 3 where it contacts the relector 2, at the edges 14a of the recessed portions 14 in ribs 9 is about 310° F. Also, at the inner periphery of the disc portion 3A of the heat shield 3, shown at 18, the temperature is approximately 350° F. under these conditions. One design criterion is to insure that at region or edge 14 temperatures do not reach a high enough temperature to cause degradation of the plastic reflector body 2. If this criterion is met at edges 14a, then it can be safely assumed that no degradation of the reflectorized surface 16 will result due to generation of heat at the surface of the bulb glass, as shown at 57.

The air gap 12 disposed radially outwardly of tubular portion 58 of heat shield 3 and the air gap 15 located adjacent a predetermined radius along the main portion 3A of the heat shield 3 functions as an insulator to prevent high temperature being reached in the corresponding adjacent regions of the plastic reflector body 2. Such air gaps permit only radiation type heat transfer as opposed to conduction heat transfer which would occur if the plastic reflector material touched the heat shield material in these regions. It is also noted that the stainless steel heat shield material is a relatively poor emitter, a poor electric conductor but is a relatively good light and heat reflector.

Although the heat shield of the present invention is intended primarily for use with a plastic body reflector the heat shield may also used in conjunction with metal reflectors, or reflectors of other material where it is desired to have an additional means to remove heat from the region of the reflector near the lamp.

It is noted that although an air gap 13 is shown between the heat shield 3 and the bulb 5, flashlight lamps occasionally are inserted in a crooked fashion, or the pins may become bent during use and therefore the bulb may be tilted to one side and touch the heat shield 3. Such touching is acceptable, although, it is preferred that a small air gap exist between lamp 4 and the heat shield 3. What is more important is that air gaps 12 and 17 be maintained between the heat shield 3 and the reflector body 2.

As shown in the FIG. 1 preferred embodiment the disc portion 3A of the heat shield 3 extends out to and physically contacts the rearward surfaces of the ribs 9 of the plastic reflector 2. In this configuration the ribs 9 act not only as anchors, or physical supports of the metal shield and the reflector, but also function as heat sinks for heat transferred from the lamp filament 6 through the heat shield 3. Although it is preferred to have the heat shield 3 configured such that heat is transferred to the ribs 9, acceptable reflector assemblies may be constructed which do not provide for heat transfer to ribs but rather are of sufficient means to act as the heat sink, or will transfer heat to some other remote component which acts as a heat sink.

Although the reflector assembly of the present invention may be used for virtually any flashlight or portable light application where it desired to remove excess heat from near the base of the reflector, the preferred embodiment is intended for use with a three cell, AA sized flashlight similar to that disclosed in co-pending application Ser. No. 111,538. In such an application the diameter of the aperature 11 in the heat shield 3 is approximately 0.147 inches. The diameter of the heat shield itself is approximately 0.600 inches. The thickness of the disc portion 3A of the heat shield 3 is approximately 0.02 inches, with the tubular portion 58 of the heat shield 3 extending perpendicularly from the main disc body portion an additional 0.070 inches. Recess 14 in the rearward surface of ribs 9 has a diameter of approximately 0.600 inches to provide a tight, press fit of the heat shield 3 into the lower region of the reflector body 2. A second smaller recessed area 17 is also provided therein which defines air gap 15. Recessed area 17 has a diameter of approximately 0.300 inches. The depth of recessed area 14 is approximately 0.025 inches and the depth of the recessed area 17 is of approximately 0.010 inches. The diameter of the central aperture 10 through the reflector body 2, as shown in FIG. 1, is approximately 0.187 inches.

Referring to FIGS. 6–10, several alternate embodiments of the heat shields are shown configured within the reflector 2. In general, the heat shield may vary in the dimensions of the diameter of the disc portion 3A, the thickness of the disc portion 3A, and the height, thickness and diameter of the tubular portion 58. For example, it may be seen that in FIG. 6, the disc portion 3A has a second cylindrical portion 3C which extends rearwardly from the main disc portion 3A to provide an extra heat sink and mechanical support. Referring to FIG. 7, it may be seen that the disc portion 3A is of a smaller diameter than that of the FIG. 1 embodiment disc portion 3A, but is of a greater thickness. Referring to FIG. 8 it may be seen that the sizing of the tubular portion 58 of the heat shield is slightly longer than that as shown in the FIG. 1 embodiment. Referring to FIG. 9 it may be seen that the diameter of the main disc portion 3A is smaller than that of the FIG. 1 embodiment. Referring to FIG. 10 it may be seen that the main disc portion 3A is even smaller than that of the FIG. 9 embodiment.

The above described embodiments may be constructed with numerous alterations and equivalent features, all of which are intended to be covered by the scope of the present invention. The above disclosed embodiments are not intended to limit the invention but rather to illustrate preferred embodiments within the scope of the present invention, which is defined by the following appended claims.

We claim:

1. A reflector assembly including:

a reflector body made of a first material and defining a centrally disposed aperture therein; and a heat shield made of a second material and defining a first portion and a second portion, said first portion having a first outer diameter throughout a major portion of its length and extending into said aperture in said reflector body, said second portion having a second outer diameter throughout a major portion of its length and being disposed behind said reflector body, said second outer diameter being greater than the first outer diameter.

2. The reflector assembly of claim 1 wherein the reflector has a substantially parabolic shape.

3. The reflector assembly of either of claims 1 or 2 wherein the reflector material is a high temperature plastic.

4. The reflector assembly of either of claims 1 or 2 above wherein the heat shield material is of stainless steel.

5. The reflector assembly as in claims 1 or 2 wherein said second body portion defines an annular disc-shaped body member having an inner diameter and said first body portion defines a tubular member projecting perpendicularly from said body portion, said tubular member having an inner diameter substantially equal to the inner diameter of said body member.

6. The reflector assembly of either of claims 1 or 2 above wherein the reflector includes a plurality of ribs which extend away from a first wall of the reflector and wherein the main body of the heat shield extends radially outward from a centerline toward and contacts said plurality of ribs.

7. A flashlight reflector assembly including a substantially parabolic reflector comprising a high temperature plastic material having a plurality of ribs extending outwardly from a first side of the parabolic reflector and a reflectorize coating on the second side of said reflector and, a hole positioned in the center of the parabolic reflector at its converging end, a heat shield positioned at the converging end of the reflector assembly and having a disc portion and a tubular portion wherein the disc portion extends radially outward from said hole and matingly engages with said ribs of said reflector and wherein said tubular portion extends perpendicularly from a first end of said disc portion and extends into said hole in said reflector.

8. A reflector assembly including:

a parabolic reflector having a forward end, a rearward end and an aperture centrally disposed in the converging end;

a heat shield comprising a first heat conducting member extending axially along the length of said aperture and radially within the periphery of said aperture;

means to aid in preventing high temperature being reached in the relector adjacent the heat shield along the length of said hole; and said heat shield further comprising a second heat conducting member positioned behind said back side of said reflector.

9. The assembly of claim 8 wherein the means to aid in preventing high temperature being reached in the reflector adjacent the heat shield along the length of said hole is a gap between said first heat conducting member and said reflector.

10. The assembly of claim 8 further including means to aid in preventing high temperature being reached on the back side of the reflector.

11. The assembly of claim 10 wherein the means to aid in preventing high temperature being reached on the back side of the reflector is a gap between said second heat conducting member and said back side of the reflector.

12. The assembly of claim 11 wherein said reflector is formed to a plastic material and said heat shield is formed of a heat conductive metal material.

13. A reflector assembly comprising:

a parabolic reflector having a forward end, a rearward end, an aperture centrally disposed in the rearward end, and a plurality of outwardly projecting axial ribs disposed between said forward end and said rearward end; and a heat shield including a disc-shaped body portion having a centrally disposed aperture therein and a tubular portion projecting forwardly of said body portion about the aperture in said body portion, said tubular portion extending into said aperture in said reflector and forming a securement with said reflector.

14. The reflector assembly of either of claims 13 or 12 including a first air gap disposed between said tubular portion of said heat shield and said reflector.

15. The reflector assembly of claims 13 or 12 including a second air gap disposed between said body portion of said heat shield and said rearward end of said reflector.

16. The reflector assembly of either of claims 13 or 12 including a first plurality of recessed areas in said axial ribs for receiving a portion of said body portion therein, a second plurality of recessed areas in ribs disposed radially inwardly of said first plurality of recessed areas defining a plurality of air gaps between said body portion of said heat shield and said rearward end of said reflector, and further including a second plurality of air gaps disposed between tubular portion of said heat shield and said reflector.

* * * * *